US010605446B2

(12) United States Patent
Eckert et al.

(10) Patent No.: US 10,605,446 B2
(45) Date of Patent: Mar. 31, 2020

(54) ELECTRICAL CONNECTION OF PCBS BY CLAMP SPRING CONNECTOR

(71) Applicant: LEDVANCE GmbH, Garching bei München (DE)

(72) Inventors: Klaus Eckert, Herbrechtingen (DE); Tobias Frost, Burglengenfeld (DE); Lambert Frye, Steinheim (DE); Bernd Pilhoefer, Graben (DE); Georg Scheipl, Westendorf (DE)

(73) Assignee: LEDVANCE GMBH, Garching Bei Munchen (DE)

( * ) Notice: Subject to any disclaimer, the term of this patent is extended or adjusted under 35 U.S.C. 154(b) by 0 days.

(21) Appl. No.: 16/024,958

(22) Filed: Jul. 2, 2018

(65) Prior Publication Data

US 2019/0003694 A1 Jan. 3, 2019

(30) Foreign Application Priority Data

Jun. 30, 2017 (DE) ..... 10 2017 114 730

(51) Int. Cl.

| | |
|---|---|
| ***H01R 12/71*** | (2011.01) |
| ***F21V 23/06*** | (2006.01) |
| ***H01R 4/48*** | (2006.01) |
| ***F21V 23/00*** | (2015.01) |
| ***H01R 12/52*** | (2011.01) |
| *H01R 13/24* | (2006.01) |
| *H01R 12/57* | (2011.01) |
| *F21K 9/278* | (2016.01) |
| *F21Y 115/10* | (2016.01) |

(52) U.S. Cl.

CPC ..... *F21V 23/06* (2013.01); *F21V 23/006* (2013.01); *H01R 4/4809* (2013.01); *H01R 4/4854* (2013.01); *H01R 12/52* (2013.01); *H01R 12/714* (2013.01); *H01R 12/718* (2013.01); *F21K 9/278* (2016.08); *F21Y 2115/10* (2016.08); *H01R 12/57* (2013.01); *H01R 13/2442* (2013.01)

(58) Field of Classification Search

CPC .. H01R 12/57; H01R 13/2442; H01R 4/4809; H01R 12/714; H01R 12/718

See application file for complete search history.

(56) References Cited

U.S. PATENT DOCUMENTS 4,738,625 A * 4/1988 Burton ..... H01R 12/714 439/59
5,462,443 A * 10/1995 Kurbjuhn ..... H01R 12/57 439/78
5,759,049 A * 6/1998 Gerber ..... H01M 2/1044 439/74

(Continued)

FOREIGN PATENT DOCUMENTS

CN 205303751 U 6/2016
DE 10006530 A1 * 8/2001 ..... H01R 12/32
DE 102011114936 A1 4/2013

*Primary Examiner* — Tho D Ta
(74) *Attorney, Agent, or Firm* — Hayes Soloway PC

(57) ABSTRACT

A light fixture includes a light-emitting diode chip, a driver electronic, a first circuit board and a second circuit board, wherein the light-emitting diode chip is mounted on one of the two circuit boards and the driver electronic is mounted on the other one of the two circuit boards and a first conductive track of the first circuit board and a second conductive track of the second circuit board are connected electrically to one another with a spring contact.

10 Claims, 8 Drawing Sheets

(56) References Cited

U.S. PATENT DOCUMENTS 7,300,320 B2 * 11/2007 Lee ..... H01R 13/2442
439/862
8,162,673 B2 * 4/2012 Chen ..... H05K 9/0064
439/66

* cited by examiner

ELECTRICAL CONNECTION OF PCBS BY CLAMP SPRING CONNECTOR

TECHNICAL FIELD

The present invention relates to a light fixture, as well as a spring contact, for electrical connection of two circuit boards.

TECHNICAL BACKGROUND

Light fixtures with light-emitting diode chips as light-emitting components, in particular for use as a LED retrofit lamp, usually include a light module, which contains the light-emitting diode chips mounted on a circuit board, and at least one driver module, which contains an electronic driver mounted on another circuit board. Such modular structure, that is to say the division into several assemblies, simplifies the assembly of the light fixture and thus is preferred for structural reasons.

For an electrical connection between the circuit board of the light module and the circuit board of the driver module, the conductive tracks of the circuit boards are generally electrically connected by means of a soldered joint or by means of a combination of wire contacts, displacement contacts and/or clamping contacts. However, a soldered joint is labor-intensive and therefore expensive steps are necessary, which cannot be automated or can only be poorly automated. Moreover, the separation of a soldered joint is associated with high cost, so the maintenance of conventional light fixtures is likewise expensive. Furthermore, combinations of wire contacts, displacement contacts and/or clamping contacts are expensive to purchase.

SUMMARY OF THE INVENTION

Starting from the disadvantages described above, it is an object of the present invention to provide a light fixture which can be produced cost-effectively with a reliable electrical connection between circuit boards of the light fixture. Furthermore, the present invention will provide a spring contact for cost-effective and reliable electrical connection of two circuit boards, in particular in a light fixture.

These objects are achieved by a light fixture and a spring contact with the features of the independent claims. Advantageous further embodiments are apparent from the dependent claims, the description, the drawings and the exemplary embodiments described in connection with the drawings.

Accordingly a light fixture is specified, comprising a light-emitting diode chip, an electronic driver, a first circuit board and a second circuit board. The light-emitting diode chip is mounted on one of the two circuit boards and the electronic driver is mounted on the other one of the two circuit boards. A first conductive track of the first circuit board and a second conductive track of the second circuit board are electrically conductively connected to one another by means of a spring contact.

The connection of the first and the second circuit board by means of a spring contact has several advantages. A spring contact can be produced cost-effectively and can be used flexibly. Moreover, it is possible to miniaturize a spring contact so that the limited installation space available on the circuit boards is taken into account. Furthermore, a spring contact is reliable and mechanically robust, so that a mode of operation can be guaranteed over the entire service life of the lamp. The electrical connection can also take place by a fully-automated production, so that no expensive manufacturing steps are necessary.

The light fixture preferably has a plurality of light-emitting diode chips. Furthermore, the first (and/or second) circuit board preferably has at least two, in particular precisely two, first (and/or second) conductive tracks, wherein preferably in each case one single first conductive track and one single second conductive track are connected to one another by means of a spring contact, in particular one single spring contact. Moreover, it is possible that the light fixture has several first and/or second circuit boards which are electrically connected to one another by using spring contacts. If in the present application indefinite articles such as "a" or "an" are used, a single number or a plurality may be meant, in particular in the context of "at least one" or "one or several", provided that this is not explicitly precluded, for example by the expression "precisely one" or "one single".

The light-emitting diode chip may be an inorganic or organic light-emitting semiconductor chip. In operation the light emitting diode chip preferably emits white light. Either the light-emitting diode chip is mounted on the first circuit board, wherein the electronic driver in this case is mounted on the second circuit board, or the light-emitting diode chip is mounted on the second circuit board, wherein the electronic driver is then mounted on the first circuit board.

The first and/or second circuit board may be any circuit board, in particular a printed circuit board. The first (and/or second) conductive track can be printed onto the first (and/or second) circuit board. For example, the first and/or second conductive track is formed with tin and/or copper.

The electronic driver can contain electronic components, such as for example a resistor, a capacitor, an inductor, a current transformer and/or a transistor, for activation of the light-emitting diode chip. In particular the electronic driver is electrically connected to a base of the light fixture. The base introduces the light fixture into a lamp socket. The current provided by the lamp socket or the provided voltage, in particular the mains voltage, is converted by means of the electronic driver into an operating current or an operating voltage of the light-emitting diode chips. The operating voltage or the operating current is transmitted to the light-emitting diode chips by means of the spring contact.

The spring contact preferably has resilient properties. In other words, the spring contact can be elastically deformed, in particular compressed, by applying a force. If the force is removed then the spring contact reverts to its original form, with an exception for overstretching or over-compressing the spring contact. In particular the spring contact present in the light fixture is in a stressed state, that is to say the spring contact is compressed. As a result of the spring contact's elasticity, it is possible that a restoring force (referred to below as a "residual spring force") acts on the first circuit board and/or the second circuit board, so that a reliable electric contact is made possible. Thus, the restoring force can lead to a lasting exertion of pressure from the spring contact onto the conductive tracks of the two circuit boards.

The spring contact preferably comprises a connection region to connect to the second circuit board, a spring arm and, in particular a curved spring segment, which connects the spring arm to the connection region. The spring contact, specifically the spring arm of the spring contact, can be constructed without winding. Thus the spring contact is not constructed in the same manner as a helical compression spring or helical tension spring. The elastic characteristics of the spring arm are preferably, in particular exclusively, induced by the choice of the material for the spring arm and/or by the bend of the spring segment, such as by the curvature of the bend and/or the radius of the bend.

In a preferred embodiment the first circuit board and the second circuit board run parallel to one another. A parallel arrangement of the two circuit boards enables a maximum utilization of space inside the light fixture and can further simplify mounting the light fixture. In particular, each of the circuit boards has a main extension plane in which it extends in the lateral direction. The main extension planes of the first and second circuit board then extend parallel to one another. Perpendicular to the main extension plane of the respective circuit board, in the vertical direction, this circuit board has a thickness which is small by comparison with the extent of the circuit board along the lateral directions.

In this case, and in what follows, mathematical terms such as "parallel" and "perpendicular" should not be interpreted in the strict mathematical sense, but also include deviations due to manufacturing tolerances. For example, in this context two objects extend "perpendicularly" relative to one another when they enclose an angle of at least 80° (and correspondingly at most 100°) with one another. Accordingly, a "parallel arrangement" of two objects is also provided when two imaginary extensions of each of the two objects meet in a point at an angle of at most 10°.

The first and the second circuit board can be arranged spaced apart from one another in the vertical direction. In a plan view of the main extension planes of the first and second circuit board, the circuit boards overlap one another. A spacing between the first and second circuit board is preferably firmly defined, so that the formation and/or attachment of the spring contact can be made easier. By providing a firmly defined spacing, the light fixture can have structural elements, such as retainers, webs and/or spacer elements, so the first circuit board and/or the second circuit board can be held in a fixed position.

According to a preferred embodiment, the spring contact is fastened on the second circuit board by means of a soldered connection and/or a clamp connection. Thus, in particular it is possible that the spring contact is mechanically and firmly connected to the second circuit board. Preferably there is no mechanically, firm connection to the first circuit board or a mechanically, releasable connection because, for example, the spring contact touches the first circuit board only in the first conductive track.

In the event of a soldered connection a part of the spring contact is soldered onto the second circuit board. For example, the spring contact is soldered onto a mounting surface of the light-emitting diode chip, the electronic driver or a base surface of the second circuit board opposite the mounting surface. The spring contact is preferably soldered onto the surface of the second circuit board which is facing the first circuit board. For example, if the second circuit board is arranged in the vertical direction above the first circuit board (i.e. the base surface of the second circuit board is facing a mounting surface of the first circuit board comprising the light-emitting diode chip or the electronic driver) then in this case, the spring contact is preferably soldered onto the base surface.

In the case of a clamp connection, the spring contact has, for example, a connection region where the spring contact can be clamped firmly on the second circuit board. The clamp connection is preferably mechanically and non-destructively releasable. In other words, the spring contact can be removed from the second circuit board without the use of releasing means and/or without the destruction of one of the connecting components, in particular from regions of the second circuit board. This facilitates reworking and/or maintenance of the light fixture.

Alternatively or in addition to the soldered connection and/or the clamp connection, it is possible that the spring contact is soldered onto the second circuit board by means of surface mounting; the spring contact is then designed as a so-called surface mounted device, SMD. Furthermore, alternatively or in addition to the soldered connection and/or the clamp connection, it is possible that the spring contact is constructed as a plug-in contact, is suitable for plug-in mounting (pin-in-hole component) and/or is connected to the second circuit board by means of soft soldering (so-called pin-in-paste component).

According to at least one embodiment of the light fixture, the spring contact has two clamping arms. The clamping arms are connected to one another by means of a curved central segment and extend along a main extension plane of the second circuit board. The clamping arms together with the central segment can form the connection region of the spring contact. The connection region can, for example, have the shape of a simple hair clip. In particular, the clamping arms together with the central segment are constructed in the form of tweezers.

According to at least one embodiment, the second circuit board is clamped between the two clamping arms. Thus, in this embodiment the spring contact is fastened on the second circuit board by means of a clamp connection. In particular, the clamping arms extend along the mounting surface and/or the base surface of the second circuit board. One of the clamping arms preferably adjoins the mounting surface of the second circuit board, whilst the other clamping arm adjoins the base surface. In particular, one of the clamping arms is in direct contact with the second conductive track of the second circuit board. The central segment can be arranged on a side edge of the second circuit board. Thus, on the one hand, a mechanical connection can be produced between the spring contact and the second circuit board due to the clamping. On the other hand, an electrical contact of the second conductive track of the second circuit board can be ensured by the spring contact.

According to at least one embodiment of the light fixture, the spring contact extends in a curved manner to at least one end region of the spring contact. The bend of the spring contact is configured in such a way that an end edge of the spring contact projects away from the first circuit board and/or the second circuit board. In this case, and in what follows, the end edge of the spring contact is an outer edge of the spring contact. The end region of the spring contact can adjoin the outer edge. Attachment of the spring contact to the second circuit board and/or connection of the two circuit boards can be simplified by the curved configuration of the end region. A rounded bend which slides over the first and/or the second conductive track can be produced, in particular by the curved configuration. In contrast to this, in the case of a spring contact extending in a straight line in the end region, the end edge would directly adjoin the first conductive track and/or the second conductive track, so that the material of the first or second conductive track of the first or second circuit board could be scratched during the assembly of the circuit board with the spring contact.

The spring contact has in particular two end edges in two end regions, wherein the first end region adjoins the first circuit board and the second end region adjoins the second circuit board. The spring contact is curved in at least one of the two end regions, so that a first end edge in the first end region projects away from the first circuit board and/or a second end edge in the second end region projects away from the second circuit board. Preferably the spring contact is curved in both end regions.

According to at least one further embodiment of the light fixture, a bend of the spring contact touches the first conductive track of the first circuit board and/or the second circuit board in a contact region of the first circuit board or in a contact region of the second circuit board (in which the spring contact touches the base surface of the second circuit board). The contact region of the first circuit board or the contact region of the second circuit board can be located, for example, on the mounting surface of the first or the second circuit board, in particular in the region of the conductive tracks. In particular the spring contact can have a first bend, which touches the first conductive track in the contact region of the first conductive track, and a second bend which touches the second conductive track in the contact region of the second conductive track. The bend is induced in particular by the curved configuration in the end region of the spring contact. Due to the bend an easily sliding contact can be provided, in particular in the contact region of the first circuit board and/or in the contact region of the second circuit board, so that damage to the first conductive tracks and/or the second conductive tracks by the spring contact is avoided.

It is possible that the spring contact has the two clamping arms connected by means of the central segment, wherein one of the clamping arms ends in an end region has a bend, so that the end edge in the region of the second circuit board projects away from the second circuit board. Due to the bend, the spring contact can be mounted more easily on the second circuit board, since bending apart the two clamping arms by the second circuit board operates in a similar manner as a hair clip.

According to at least one embodiment of the light fixture, the dimensions of the spring contact are selected in such a way that in the contact region of the first circuit board the spring contact exerts a residual spring force on the first circuit board and in the contact region of the second circuit board the spring contact exerts a residual spring force on the second circuit board. The forces which the spring contact exerts on the first circuit board and the second circuit board preferably cancel one another out. It is also possible that the torques present in the system of the spring contact cancel one another out. In particular a first torque, which the spring contact has in the contact region of the first circuit board, can be opposed to a second torque, which the spring contact has in the contact region of the second circuit board. The effective forces can be adjusted, in particular by means of the geometric dimensions of the spring contact.

According to at least one embodiment of the light fixture, a spring deflection of the spring contact corresponds at least to the thickness of the first circuit board. The spring deflection of the spring contact is the difference between the unstressed state and the stressed state of the extension of the spring contact in the vertical direction, wherein the stressed state is provided if the spring contact connects the two circuit boards electrically to one another. Thus, in the unstressed state, the spring contact can extend away from the second circuit board, beyond the first circuit board. A large spring deflection can facilitate a strong restoring force of the spring and thus ensure a reliable connection.

According to at least one embodiment, the spring contact makes contact with the second conductive track of the second circuit board in a planar manner. Thus, the spring contact is flat, at least in the region of the second circuit board, and touches a surface of the second conductive track. As a result, the electrical contact of the second conductive track can be improved, and in particular a small electrical resistance can be achieved.

Furthermore, a spring contact is specified. The spring contact is provided to create an electrical connection between a first conductive track of a first circuit board and a second conductive track of a second circuit board. In particular, the spring contact is suitable for electrical connection between conductive tracks of a first circuit board and a second circuit board in a light fixture described here. In other words, all features disclosed for the light fixture are also disclosed for the spring contact, and vice versa.

The spring contact has a connection region for mechanically connecting the spring contact to the second conductive track and a spring arm for electrically connecting the first conductive track. The second (and/or first) circuit board and the second (and/or first) conductive track can, in particular, be the previously described second (and/or first) conductive track or the second (and/or first) circuit board.

In a preferred embodiment the spring contact is formed in one piece. In this case and in what follows, "in one piece" can mean that the spring contact consists of one part and, in particular has no boundary surfaces. Thus, the spring contact is formed, in particular, integrally or in one part. For example, the spring contact is formed from a contiguous workpiece, such as a sheet metal strip.

According to at least one embodiment of the spring contact, the connection region and the spring arm are connected to one another by means of a curved spring segment. A spring action of the spring arm can be provided by means of the spring arm itself and the spring segment.

According to at least one embodiment, in a side view the spring contact has a S shape or a V shape. In particular, in the case of V shape the two branches of the V can have unequal lengths and/or can extend in a curvilinear manner, for example in the manner of a small Greek Ny. The spring segment can, for example, form one of the bends of the S or the bend of the V. The spring contact in the case of a S or V shape is preferably provided in order to be soldered onto the second circuit board. For example, one branch of the V of the spring contact is provided in order to be soldered to a base surface of the second circuit board.

According to at least one embodiment of the spring contact, the connection region has two clamping arms, which are connected to one another by means of a curved central segment. The clamping arms are arranged at an angle of at least 180° and at most 200° relative to one another. For the production of the connection region, for example, a straight sheet metal strip can be bent at the position of the central segment by at least 180° and at most 200°. An angle at which the clamping arms are arranged relative to one another is at least 190°. The curved central segment in particular follows at least a half circumference of a circle. In this case and in what follows, "arranged at an angle relative to one another" means that the two clamping arms intersect at this angle in an imaginary extension. Thus, the clamping arms extend obliquely relative to one another. The arrangement is preferable because the spacing between the two clamping arms becomes smaller as the distance from the central segment increases. The greatest spacing between the two clamping arms is then located on the central segment.

In particular, between the two clamping arms a free space is formed, which is provided to receive and clamp the second circuit board. Due to the oblique arrangement of the two clamping arms relative to one another, the clamping arms can exert a clamping force on the second circuit board that increases with increasing distance from the central segment.

The spring contact can be formed, in particular, with or include a first clamping arm, a second clamping arm, a central segment connecting the two clamping arms, a spring arm and a spring segment connecting the second clamping arm and the spring arm. The clamping arms extend substantially along a longitudinal axis of the spring contact. The spring arm extends oblique relative to the longitudinal direction and oblique relative to a vertical axis. The extension of the spring arm along the longitudinal axis or the vertical axis can be adjusted by the strength of a bend of the spring segment. The first clamping arm preferably has a first end edge of the spring contact and the spring arm has a second end edge of the spring contact.

If the spring contact is used in a light fixture the longitudinal axis can extend along one of the lateral directions, and the vertical axis can extend along the vertical direction. Furthermore, in the event of an installation the extension of the spring arm in the vertical direction can be adapted to the spacing of the two circuit boards in the vertical direction. The spring forces acting on the two circuit boards can in particular be adjusted by means of a length of the second clamping arm, a length of the spring arm and the bend of the spring segment.

According to at least one embodiment, the spring contact has a protrusion. The protrusion is provided in order to engage in a corresponding indentation in the second circuit board, in particular in the second conductive track. In particular, in a light fixture having the spring contact, the second circuit board can have the indentation. The protrusion can serve as position alignment, in particular, when interacting with a corresponding indentation in a circuit board. The protrusion can, for example, be stamped out of the spring contact material. The corresponding indentation in the circuit board can be a hole in the circuit board.

In particular, it is possible that one of the clamping arms of the spring contact has the protrusion. In a light fixture having the spring contact, the second circuit board can then have a corresponding protrusion on its mounting surface and/or its base surface. Preferably each clamping arm has a protrusion, wherein the protrusion protrudes into the free space arranged between the clamping arms. The second circuit board of the light fixture then preferably has an indentation on the base surface and an indentation on the mounting surface, wherein the protrusions engage in the indentations of the second circuit board.

According to at least one embodiment of the spring contact, the spring contact has a bend in at least one end region. The end region having the bend can be part of the spring arm and/or part of the connection region. In particular, the spring arm of the spring contact can have a bend in one end region. The bend can be provided for electrical contact of a conductive track of one of the circuit boards. Alternatively, or in addition, the spring contact can have a bend in the connection region. In particular, a clamping arm of the spring contact can have a bend in one end region of the spring contact.

According to at least one embodiment of the spring contact, the spring arm extends in a straight line in an end region of the spring contact. In particular, in the event of installation of the spring contact in a light fixture, the end edge of the spring contact can touch the first conductive track of the first circuit board in a contact region of the first conductive track. In this case the spring contact has no rounded region, in particular no bend, for contacting a conductive track. The end edge can then form a sharp region for contacting the conductive track. As a result, a well-defined contact region can be provided in a light fixture.

According to at least one embodiment, the spring contact is formed from a sheet metal strip. For production of the spring contact, first of all a sheet metal strip can be provided. The sheet metal strip extends along a length and has a width extending perpendicular to the length which is substantially smaller than the length. The edges of the sheet metal strip extending along the width can form the end edges of the spring contact. The sheet metal strip is bent and/or stamped for production of the spring contact according to the required shape of the spring contact. In particular, the bending takes place in the region of the central segment, the holding segment and/or, if appropriate, the present bend. Before or after the bending the sheet metal strip can optionally be provided with stampings for providing protrusions in the spring contact.

According to at least one embodiment, the spring contact, in particular the sheet metal strip from which the spring contact is formed, is formed by a spring steel. In particular, the spring contact can be made from a spring steel. The spring steel can be, in particular, an elastic and/or flexible material, preferably an alloy. For example, the spring steel is stainless austenitic steel, in particular 1.4310 metal (also known as: X10CrNi18-8, Acidur 4310) according to the standard DIN EN 10088-3, at the time of the filing date. Furthermore, $CuSn_6$, $CuSn_8^-$, tin, nickel and/or gold may be considered as materials for the spring contact. The spring contact can, in particular, be produced cost-effectively and the durability of the spring contact can be increased by the use of a sheet metal strip made of spring steel.

In a preferred embodiment, the light fixture is mounted by means of a simple plug-in mounting. Because of the mount, the spring contact can be fitted onto an edge of the first circuit board. The first circuit board can be engaged in a holding element, which is for example made of plastic. The second circuit board is inserted or slid into a holder, in particular a groove, so that the second circuit board extends parallel to the first circuit board, and the spring contact is connected to the second circuit board, in particular by the resilient spring arm of the spring contact sliding over the first conductive tracks of the first circuit board. A defined pressing force (corresponding to the residual spring force on the first circuit board) can be generated by a corresponding adaptation of the rigidity and/or the dimensions of the spring arms. This force that acts on the first circuit board generates a corresponding opposing force on the second circuit board. Thus, the design of the spring contact can facilitate fully-automated mounting.

BRIEF DESCRIPTION OF THE DRAWINGS

Preferred further embodiments of the invention are explained in greater detail by the following description of the drawings.

DETAILED DESCRIPTION OF PREFERRED EXEMPLARY EMBODIMENTS

Figure 1A:
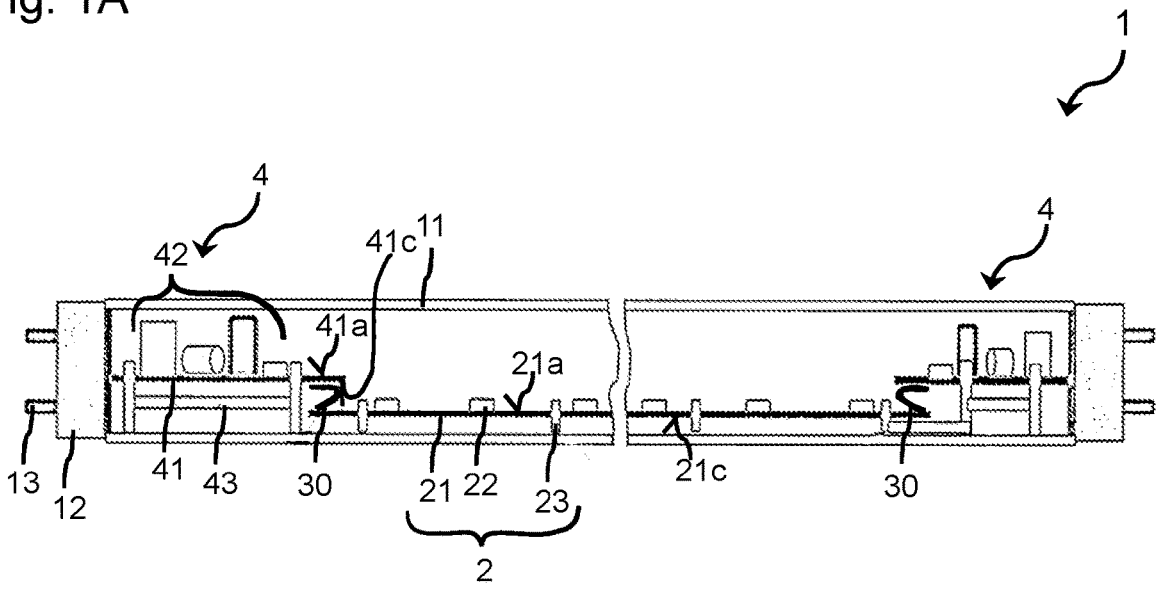
FIGS. 1A, 1B, 2A and 2B show exemplary embodiments of a light fixture described here as well as a spring contact described here.

The light fixture described here, as well as the spring contact described here, are explained in greater detail below with reference to exemplary embodiments and the associated drawings. In this case, elements which are the same, of the same kind, similar or equivalent are provided with the same reference numerals. Repeated description of some of these elements is omitted in order to avoid redundancies.

The drawings and the size ratios of the elements illustrated in the drawings elements should not be regarded as drawn to scale relative to one another. On the contrary, individual elements may be shown as excessively large for better illustration and/or to aid understanding.

An exemplary embodiment of a light fixture 1, as well as a spring contact 30, is described here in greater detail with reference to the schematic sectional representation in FIG. 1A.

The light fixture 1 in the present case is a retrofit light fixture as a replacement for a fluorescent tube. The light fixture 1 comprises two driver modules 4 and a light module 2. However, unlike the illustration in FIG. 1A, the light fixture 1 can also have only one driver module 4 or more than two driver modules 4. The driver modules 4 and the light module 2 are introduced into a tube 11, which may be a light-permeable glass and/or plastic tube. The ends of the tube 11 are in each case introduced into a housing 12 with contact pins 13. The housing 12 serves as the electrical contact and the mechanical mounting of the light fixture 11 in a lamp socket.

The light module 2 has a plurality of light-emitting diode chips 22, which are mounted on a mounting surface 21*a* of a common first circuit board 21. The first circuit board 21 is retained by means of first retainers 23 in the tube 11 of the light fixture 1.

The driver module 4 has in each case a driver electronic 42, which are mounted on a mounting surface 41*a* of a common second circuit board 41. The first circuit board 21 and the second circuit board 41 are, in particular, different from one another. The second circuit board 41 is retained by means of second retainers 43 in the tube 11 of the light fixture 1.

For example, the mounting surface 21*a* of the first circuit board 21 has the first conductive tracks 211 and the base surface 41*c* of the second circuit board 41 has the second conductive tracks 411.

The driver electronic 42 of the driver module 4 comprises electronic components which serve for electrical activation of the light-emitting diode chips 22 of the light-emitting diode module 2. In particular, the driver electronic 42 can convert a voltage provided on the contact pins 13 or a provided current into an operating voltage or an operating current of the light-emitting diode module 2.

The first circuit board 21 and the second circuit board 41 (or the second circuit boards 41) in each case have first conductive tracks 211 or second conductive tracks 411, by means of which the light-emitting diode chips 22 or the electronic components of the driver electronic 42 are electrically connected to one another (not shown in FIG. 1A). The first conductive tracks 211 of the first circuit board 21 are electrically connected to the second conductive tracks 411 of the second circuit board 41 via a spring contact 30.

In the exemplary embodiment of FIG. 1A, the spring contact 30 is mounted on a base surface 41*c* of the second circuit board 41 opposite the mounting surface 41*a* of the second circuit board 41, wherein the base surface 41*c* of the second circuit board 41 faces the first circuit board 21. However, it is alternatively or additionally possible that the spring contact 30 is mounted on the mounting surface 41*a* of the second circuit board 41.

Figure 1B:
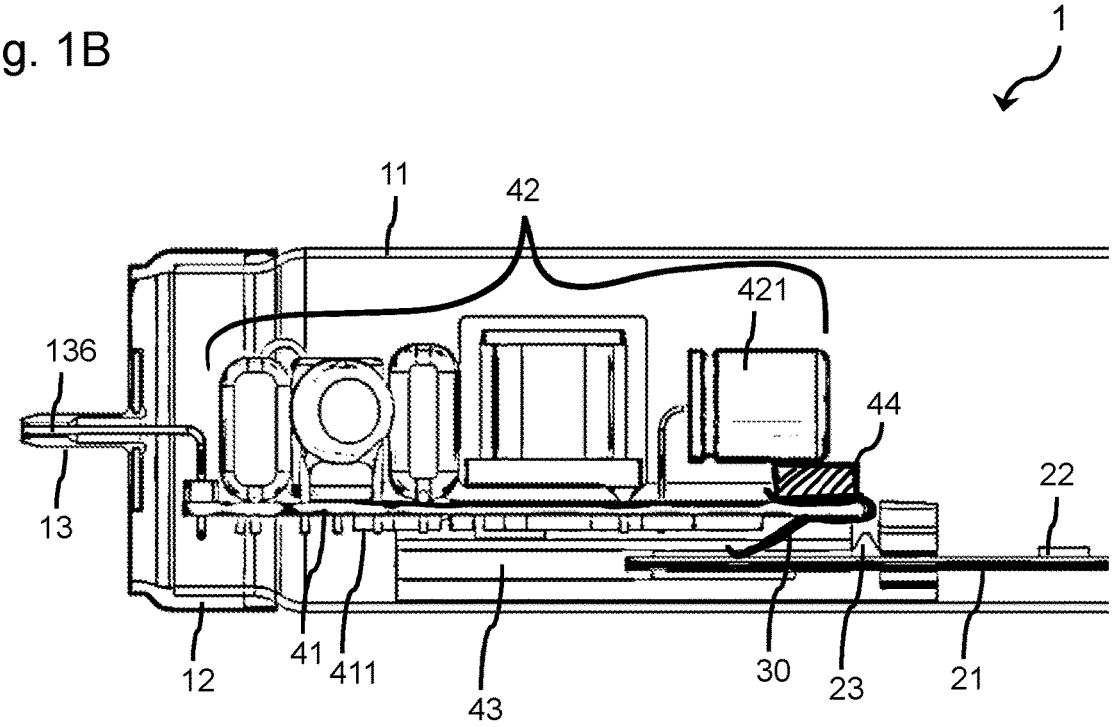

A further exemplary embodiment of a light fixture 1, as well as a spring contact 30, is described here in greater detail with reference to the schematic sectional representation in FIG. 1B. In contrast to the exemplary embodiment of FIG. 1A, the spring contact 30 is clamped on the second circuit board 41 and touches the second circuit board 41 both in its mounting surface 41*a* and also in its ground surface 41*c*. The first retainer 23 and the second retainer 43 are also connected to one another in the exemplary embodiment.

Between one of the electronic component 421 of the driver electronic 42 (in the present case the electronic component 421 is a capacitor) insulation 44 is provided, which electrically insulates the electronic component 421 from the spring contact 30. In general, due to the use of insulation 44 between a part of the driver electronic 42 and the spring contact 30, a short-circuit can be avoided and the size of the driver electronic 42, and consequently of the light fixture 1, can be further reduced.

Figure 2A:
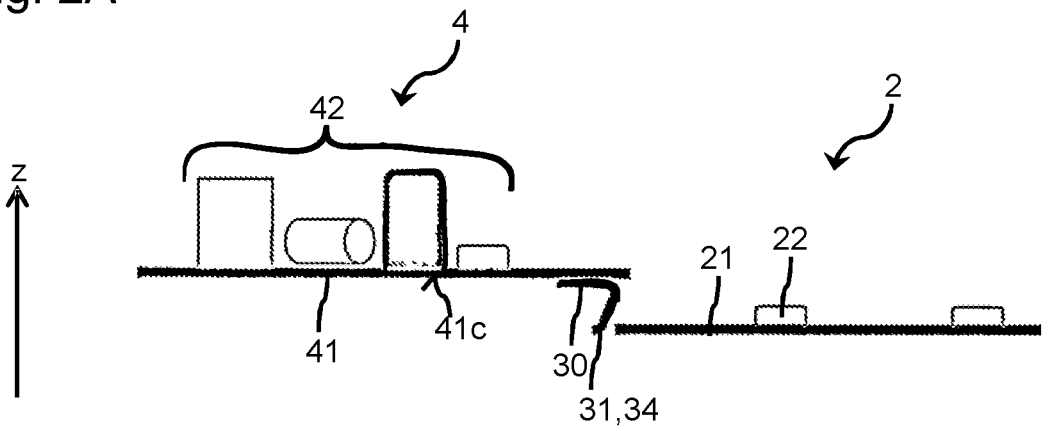
Figure 2B:
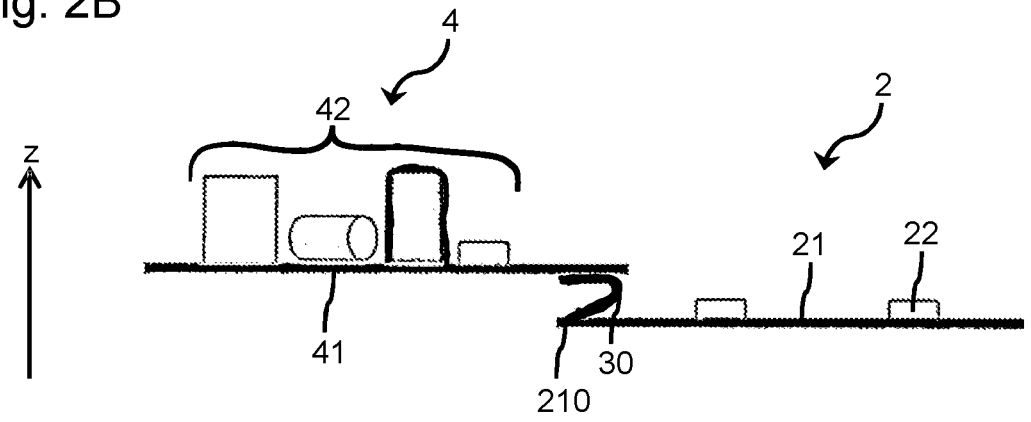

An exemplary embodiment of a light fixture 1, as well as a spring contact 30, is described here in greater detail with reference to the schematic representations in FIGS. 2A and 2B. In this case an enlarged region of a light fixture 1, according to the exemplary embodiment of FIG. 1A, is shown for general explanation of the mode of operation of the spring contact 30. FIG. 2A shows the driver module 4, the light module 2 and the spring contact 30 before they are mechanically connected, while FIG. 2B shows the driver module 4, the light module 2 and the spring contact 30 in the mechanically connected state.

In FIG. 2A the spring contact 30 is present in the unstressed state. The spring contact 30 is fastened to the second circuit board 41. Purely by way of example, in the illustrated exemplary embodiment the spring contact 30 is fastened to the base surface 41*c* of the second circuit board 41. In the unstressed state the spring contact 30 extends beyond the first circuit board 21 in a vertical direction z, and when the spring contact 30 is in the stressed state it is arranged between the first circuit board 21 and the second circuit board 41. Thus the extension of the spring contact 30 in the vertical direction z is greater than a distance between the first circuit board 21 and the second circuit board 41 in the vertical direction z.

For connection of the driver module 4 and the light module 2, the driver module 4 is preferably slid in a lateral direction (i.e. perpendicular to the vertical direction z) over the first circuit board 21, so that the spring contact 30 is compressed by the first circuit board 21 and the second circuit board 41. The lateral movement can be simplified by means of a bend 31 in an end region 303 close to a first end edge 34 of the spring contact 30 facing the first circuit board 21. Due to the bend 31, it is not the (sharp) first end edge 34 but the (smooth) bend 31 that comes into contact with the first circuit board 21, so that friction is reduced and/or scratches are avoided.

In FIG. 2B, the spring contact 30 is present in the tensioned state. The spring contact 30 touches the first circuit board 21, or the first conductive tracks 211 of the first circuit board 21, in a contact region 210 and contacts the first conductive tracks 211 in this way. In particular, the bend 31 is in the contact region 210 and is in direct contact with the first conductive tracks 211.

Exemplary embodiments of a spring contact 30 described here are explained in greater detail with reference to the schematic illustrations in FIGS. 3A, 3B, 3C and 3D. Different geometric configurations of a spring contact 30 are shown. Each of the exemplary spring contacts 30 shown in FIGS. 3A to 3D have a connection region 300 for connection to the second circuit board 41, a spring arm 301 as well as a spring segment 33 (which is notably curved) connecting the connection region 300 and the spring arm 301. Each spring contact 30 is completed by a first end edge 34 which is part of the spring arm 301, and a second end edge 35 which is part of the connection region 300.

Figure 3A:
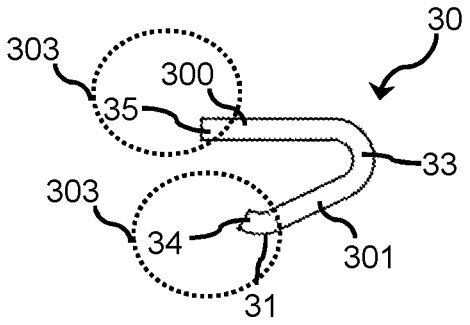
FIGS. 3A, 3B, 3C and 3D show exemplary embodiments of a spring contact described here.

The spring contact 30 of FIG. 3A has the shape of a V (tilted by 90°). The connection region 300 is straight and has no bends 31 in an end region 303 close to the second end edge 35. The connection region 300 is suitable, for example, for a soldered connection to a second circuit board 41. The spring arm 301 has the bend 31 in an end region 303, so that the first end edge 34 is curved upwards.

Figure 3B:
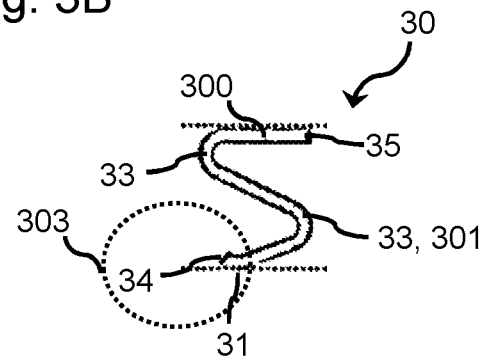
Figure 3C:
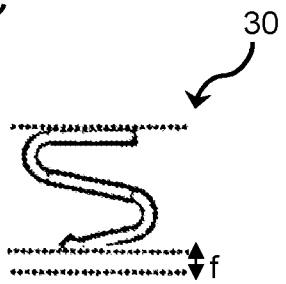

The spring contact 30 of FIGS. 3B and 3C has a S-shaped configuration. The connection region 300 is connected by means of two spring segments 33 to the spring arm 301. While FIG. 3B shows the spring contact 30 in the not tensioned state, the spring contact 30 in FIG. 3C is tensioned by a spring deflection f, so that the spring contact 30 is compressed in the vertical direction z. The spring deflection f is generally selected so that the spring contact 30 is not over stretched, which is where a complete regression of the spring contact 30 is no longer possible. In particular, the spring deflection f can be adapted by means of the shape of the spring contact 30 and/or the material of the spring contact 30.

Figure 3D:
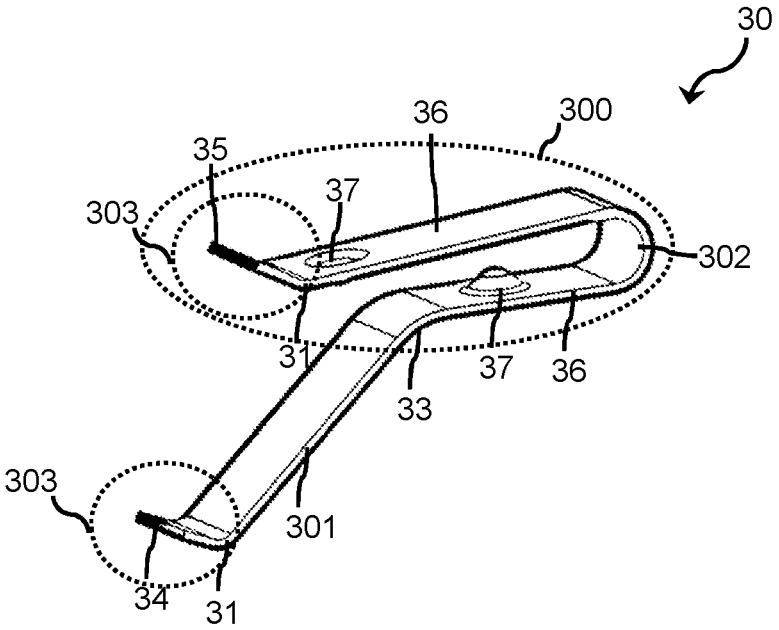

The spring contact 30 of FIG. 3D is designed as a clamping contact. The connection region 300 of the spring contact 30 has two clamping arms 36 which are connected by means of a central segment 302. A protrusion 37 which extends into a free space between the two clamping arms 36 is introduced into each of the clamping arms 36. In the end regions 303 of the spring contact 30, the spring contact comprises bends 31. The first end edge 34 and the second end edge 35 of the spring contact 30 are bent in the same direction by the bends 31.

Figure 4A:
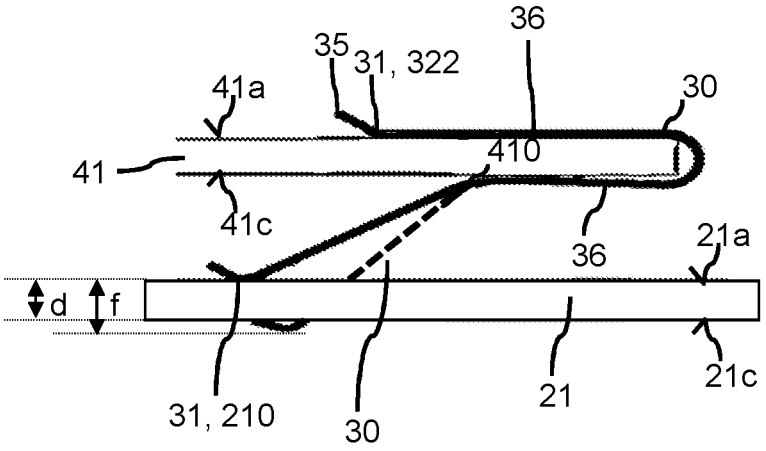
FIGS. 4A, 4B, 4C, 5A, 5B, 5C and 5D show exemplary embodiments of a light fixture described here as well as a spring contact described here.
Figure 4B:
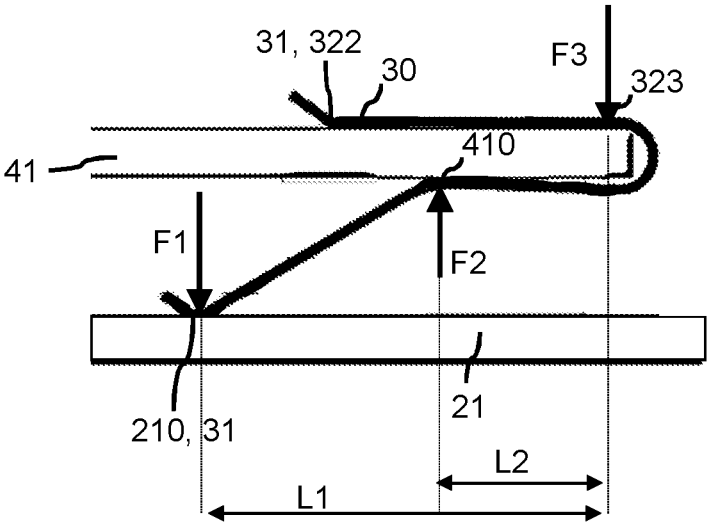
Figure 4C:
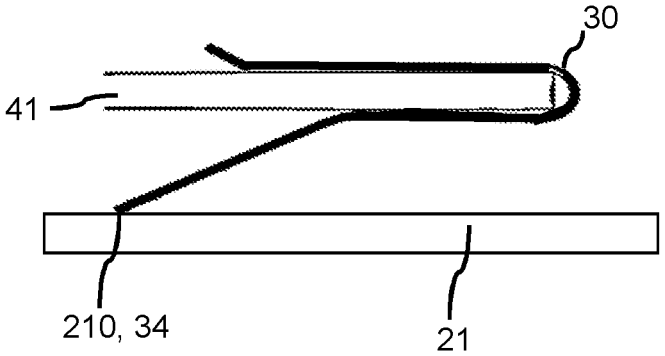

Further exemplary embodiments of a light fixture 1, as well as a spring contact 30, is described here in greater detail with reference to the schematic representations in FIGS. 4A, 4B and 4C. FIGS. 4A to 4C each show a spring contact 30 which is connected by means of a clamp connection to the second circuit board 41, wherein the second circuit board 41 is clamped between the two clamping arms 36 of the spring contact 30 (see also FIG. 3D). On the second circuit board 41 the spring contact 30 touches the base surface 41*c* in a contact region 410, and the spring contact 30 touches on the first circuit board 21 the mounting surface 21*a* in a contact region 210. The contact region 410 of the second circuit board 41 preferably comprises the second conductive tracks 411, so that in the contact region 410 an electrical connection between the spring contact 30 and the second conductive tracks 411 takes place. Furthermore, the spring contact 30 touches the mounting surface 41*a* of the second circuit board 41 in a contact region 322.

In FIG. 4A, the spring contact 30 is illustrated both in the tensioned state (solid line) and also in the not tensioned state (dashed line), that is to say in the non-connected state. From the tension of the spring contact 30, this spring contact is compressed by spring deflection f. The spring deflection f is preferably greater than a thickness d of the first circuit board 21, in order to generate, in particular, a high residual spring force on the contact region 210 of the first circuit board 21.

FIG. 4B shows a schematic sketch of the distribution of force in the system consisting of first circuit board 21, second circuit board 41 and spring contact 30. A first force F1 acts on the contact region 210 of the first circuit board 21 (this force corresponds to the residual spring force or restoring force of the spring contact 30 in said contact region 210). A second force F2 acts on the contact region 410 of the second circuit board 41 (this force corresponds to the residual spring force or restoring force of the spring contact 30 in said contact region 410). A third force F3 acts on an edge region 323 of the second circuit board 41. The edge region 323 is, in particular, the region of the second circuit board 41 in which the clamping arm 36, while touching the mounting surface 41*a*, merges into the central segment 30 that connects the two clamping arms 36. The spacing between the edge region 323 and the contact region 210 of the first circuit board 21 corresponds to a first length L1, and the spacing between the edge region 323 and the contact region 420 of the second circuit board 41 corresponds to a second length L2.

The dimensions of spring contact 30, or the dimensions of the first length L1 and the second length L2, is preferably designed in such a way that the forces cancel each other out, that is to say F1+F2+F3=0 (F1, F2 and F3 are, in each case, the force vectors of the first force, the second force and the third force). For an example of the dimension for L1, assume L2 of the spring contact has a second force F2 is twice as great as the first force F1. In this case, the first length L1 can be twice as great as the second length L2. For example, the first length L1 is 9 mm and the second length L2 is 4.5 mm. For example, the first force F1 for a single spring contact 30 is at least 4 N and at most 8 N.

The spring contact 30 of the exemplary embodiments of FIGS. 4A and 4B in each case have a bend 31 that touches the first circuit board 21 in the contact region 210 thereof. In contrast to this, the exemplary embodiment of FIG. 4C has the first end edge 34 of the spring contact 30 directly touch the first circuit board 21, or the first conductive tracks 211 of the first circuit board 21. The principles described in connection with the preceding FIGS. 4A and 4B also apply to such a spring contact 30.

An exemplary embodiment of a light fixture 1, as well as a spring contact 30, is described here in greater detail with reference to the schematic representations in FIGS. 5A, 5B, 5C and 5D. The spring contact 30 is formed as in FIG. 3D.

Figure 5A:
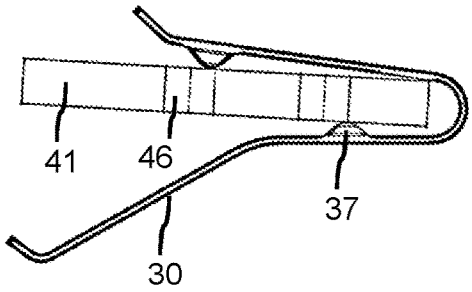
Figure 5B:
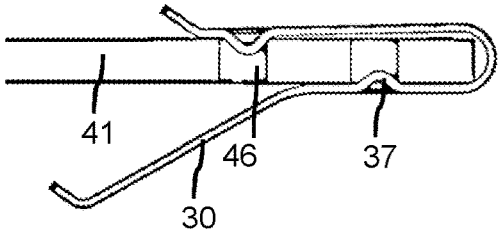
Figure 5C:
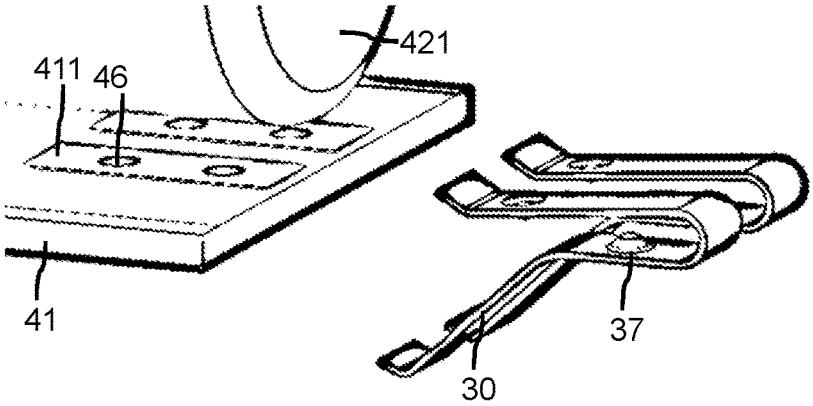
Figure 5D:
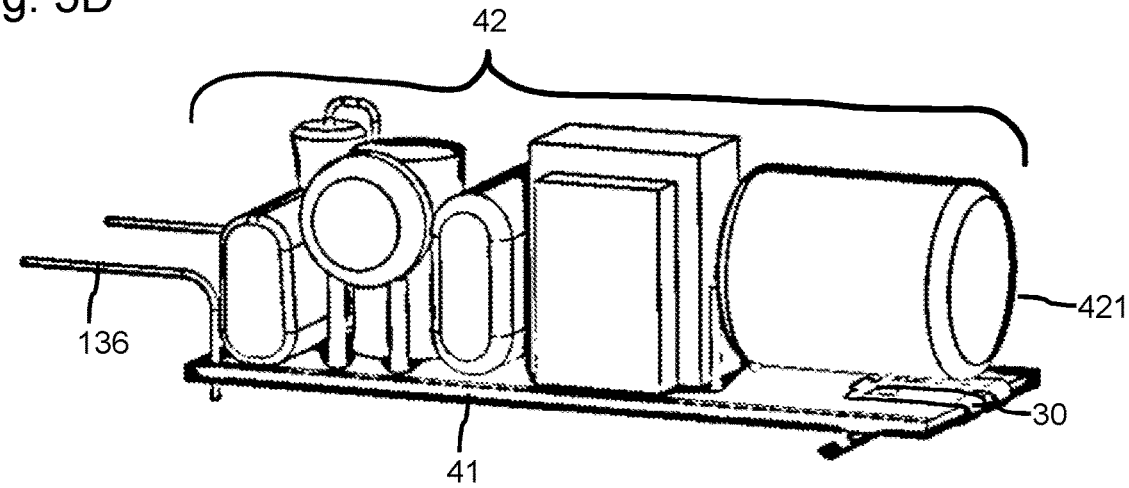

For improvement of the mechanical connection of the spring contact 30 to the second circuit board 41, the second circuit board 41 has indentations 46 that the protrusions 37 of the spring contact 30 engage (FIGS. 5A and 5B). For production of the connection, the spring contact 30 is slid over the second circuit board 41. The protrusions 37 can then engage in the indentations 46 and the spring contact 30 is fixed to the second circuit board 41 (FIGS. 5C and 5D).

Figure 6:
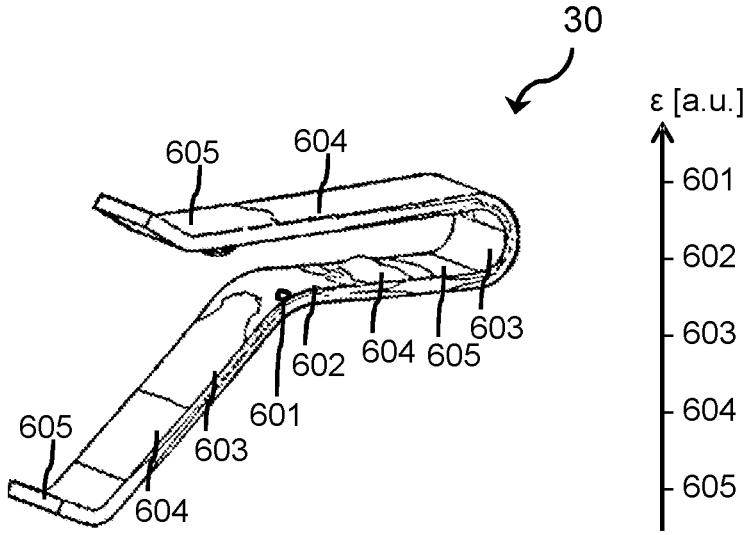
FIG. 6 shows an exemplary embodiment of a spring contact described here.

FIG. 6 shows a simulated stress distribution along a spring contact 30 of FIG. 3D introduced into a light fixture 1 (cf. also FIGS. 4A, 4B, 5A to 5D). This drawing shows first stress regions 601, second stress regions 602, third stress regions 603, fourth stress regions 604 and fifth stress regions 605, wherein the stress c (in particular the von-Mises stress) decreases as the numbers increase (see stress scale). A high stress is only to be measured in a small region on the spring segment 33. In this region the restoring force can act indirectly on the spring arm 301. The rest of the spring contact 30 only has little tension.

The first stress region 601 can, for example, correspond to a stress of at least 800 N/mm$^2$ and at most 960 N/mm$^2$. The second stress region 602 can, for example, correspond to a stress of at least 650 N/mm$^2$ and at most 800 N/mm$^2$. The third stress region 603 can, for example, correspond to a stress of at least 300 N/mm$^2$ and at most 650 N/mm$^2$. The fourth stress region 605 can, for example, correspond to a stress of at least 100 N/mm$^2$ and at most 300 N/mm$^2$. The fourth stress region 605 can, for example, correspond to a stress of at least 0 N/mm$^2$ and at most 100 N/mm$^2$.

Figure 7A:
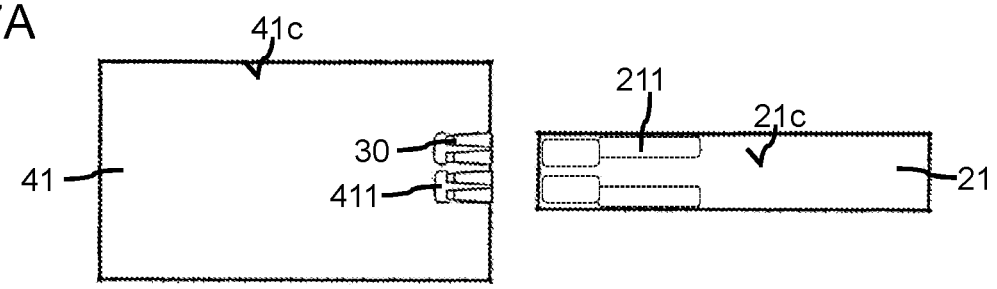
FIGS. 7A, 7B, 7C, 8A, 8B, and 8C show exemplary embodiments of a light fixture described here as well as a spring contact described here.
Figure 7B:
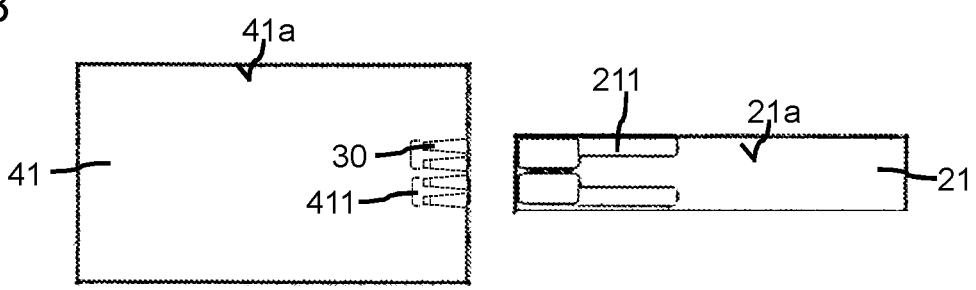
Figure 7C:
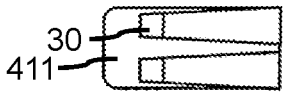

Exemplary embodiments of a light fixture 1, as well as a spring contact 30, are described here in greater detail with reference to the schematic representations in FIGS. 7A, 7B and 7C. These show possible configurations of the first conductive tracks 211 and/or the second conductive tracks 411 in the region of the contact with the spring contact 30. FIGS. 7A and 7B each show plan views of the first circuit board 21 and the second circuit board 41, in each case from different directions. FIG. 7C shows an enlargement of the second conductive tracks 411 of FIG. 7A.

The second circuit board 41 has the second conductive tracks 411 on its base surface 41*c*. The spring contact 30 can, for example, be soldered on the second conductive tracks 411.

For this purpose, an end region 300 of the spring contact 30 can be forked. The mounting surface 21*a* of the first circuit board 21 is turned towards the base surface 41*c* of the second circuit board 41. The mounting surface 21*a* has first conductive tracks 211. The first conductive tracks 211 and the second conductive tracks 411 can be solder pads which, however, are not soldered to the spring contact 30, like in the case of the first conductive tracks 211. Thus, an already existing architecture of the circuit boards 21, 41 can be used.

Figure 8A:
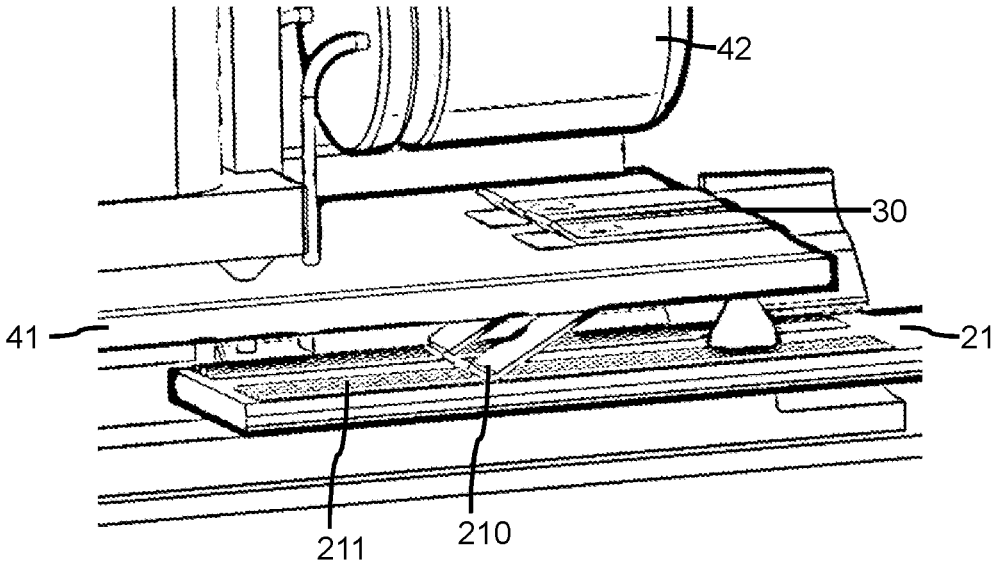
Figure 8B:
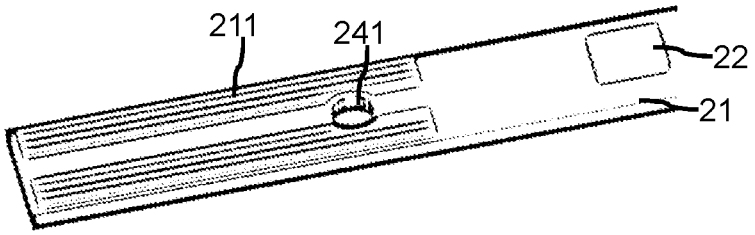
Figure 8C:
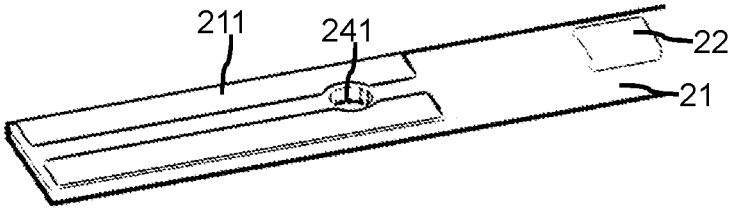

Exemplary embodiments of a light fixture 1, are explained in greater detail with reference to the schematic illustrations in FIGS. 8A, 8B and 8C. FIG. 8A again shows the spring contact 30 connected to the second circuit board 41 via a clamp connection. The spring contact 30 contacts the first conductive tracks 211 of the first circuit board 21 in a contact region 210. The first conductive tracks 211 can be mounted as thin strips, formed in particular with tin, on a conductive track, which is formed in particular with copper (FIG. 8B). It is also possible that the first conductive tracks 211 are provided in the form of a completely tin-plated and/or gold-plated copper conductive track (FIG. 8C). In particular, tin plating can significantly increase the service life of the first conductive tracks 211, which the spring contact 30 slides over during assembly.

Exemplary embodiments of an alternative light fixture 1', as well as an alternative contact 71, 72, 81, 82, are explained in greater detail with reference to the schematic representations in FIGS. 9A, 9B, 9C and 9D.

Figure 9A:
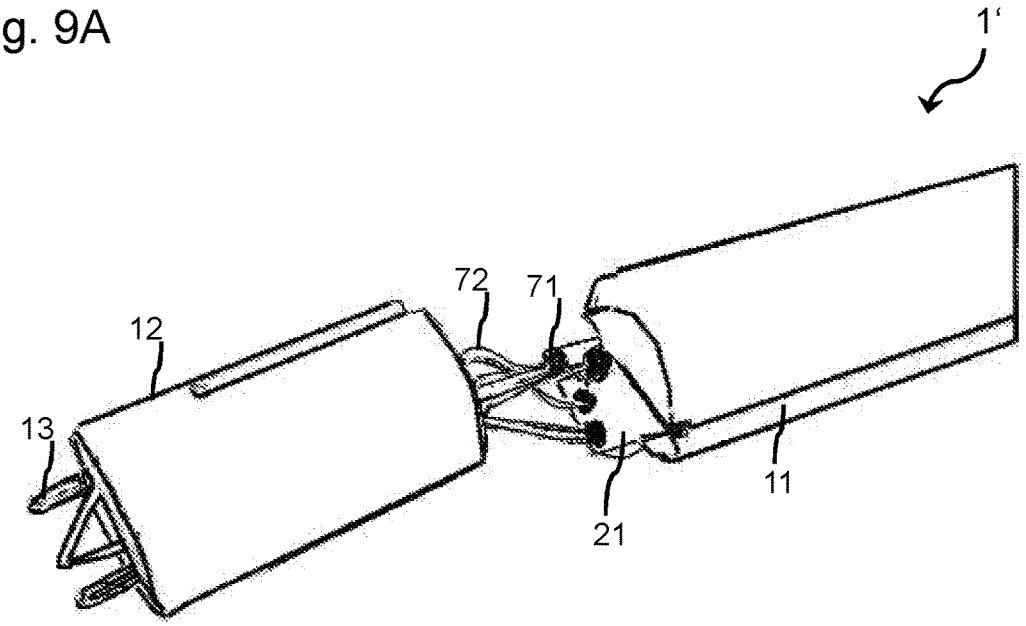
FIGS. 9A, 9B, 9C and 9D show exemplary embodiments of an alternative light fixture as well as an alternative contact.

The FIG. 9A shows an alternative light fixture 1', wherein the first circuit board 21 (contained in the tube 11) and the second circuit board 41 (contained in the housing 12) are connected by means of cables 72 which are soldered to the first circuit board 21 by means of solder points 71. However, such a soldered connection is not suitable for automation of the mounting.

Figure 9B:
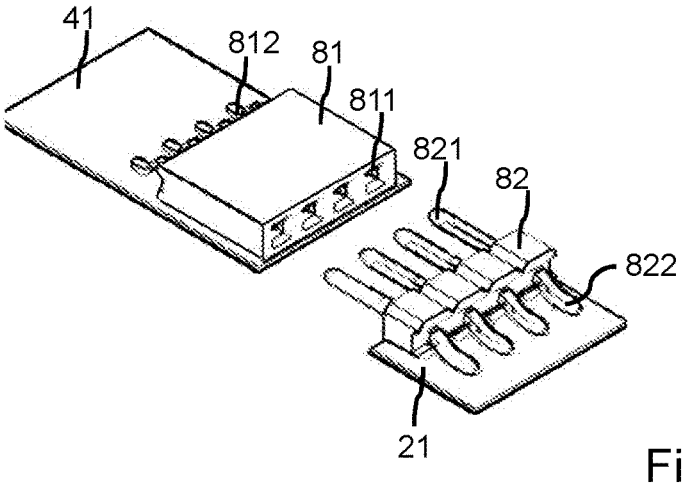
Figure 9C:
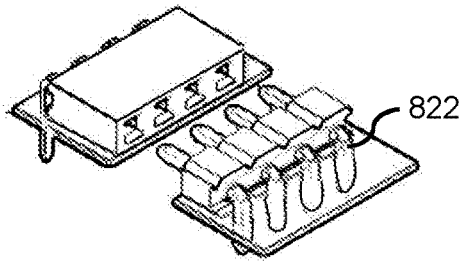
Figure 9D:
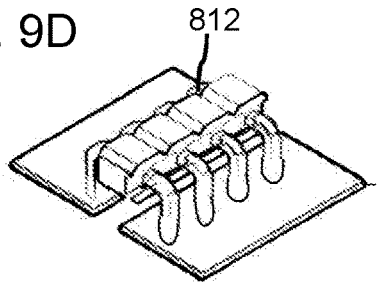

FIGS. 9B to 9D in each case show a first circuit board 21, which can be electrically connected to a second circuit board 41 by means of plug connectors 81, 82. The plug connectors in each case have a socket component 81 and an opposing plug component 82. The socket component 81 has sockets 811 to receive plugs 821 of the plug component 82. A socket contact 812 of the socket component 81 can be electrically connected by means of surface mounting (FIG. 9B) or by means of plug-in mounting (FIGS. 9C and 9D) to the second circuit board 41. Furthermore, a plug contact 822 of the plug component 82 can be electrically connected by means of surface mounting (FIG. 9B) or by means of pressure plug-in mounting (FIGS. 9C and 9D) to the first circuit board 21. The illustrated plug connectors 81, 82 enable a mechanical, non-destructive releasable connection, but here too an automated mounting is only possible to a limited extent and, moreover, the plug connectors 81, 82 are expensive to obtain (more than 10 times the price of the spring contact 30).

The invention is not limited to these embodiments by the description with reference to the exemplary embodiments. On the contrary, the invention encompasses each new feature as well as any combination of features. In particular, the invention includes any combination of features in the claims even if this feature, or this combination itself, is not explicitly given in the claims or the exemplary embodiments.

LIST OF REFERENCES

1 light fixture
1' alternative light fixture
11 tube
12 housing
13 contact pin
136 conductor
2 light module
21 first circuit board
21*a* mounting surface of the first circuit board
21*c* base surface of the first circuit board
210 contact region of the first circuit board
211 first conductive track
22 light emitting diode chip
23 first retainer
30 spring contact
300 connection region
301 spring arm
302 central segment
303 end region
322 contact region
323 edge region
31 bend
33 spring segment
34 first end edge
35 second end edge
36 clamping arm
37 protrusion
4 driver module
41 second circuit board
41*a* mounting surface of the second circuit board
41*c* base surface of the second circuit board
410 contact region of the second circuit board
411 second conductive track
42 driver electronic
421 electronic component
43 second retainer
44 insulation
46 indentation
d thickness of the first circuit board
f spring deflection
L1 first length
L2 second length
F1 first force
F2 second force F3 third force
601, . . . , 605 first, . . . , fifth stress region
71 solder point
72 cable
81 socket component
811 socket
812 socket contact
82 plug component
821 plug
822 plug contact
z vertical direction

The invention claimed is:

1. A light fixture comprising:

a light emitting diode chip;

a driver electronic; and a first circuit board and a second circuit board;

wherein the light emitting diode chip is mounted on one of the two circuit boards and the driver electronic is mounted on the other one of the two circuit boards; and wherein a first conductive track of the first circuit board and a second conductive track of the second circuit board are electrically connected to one another by means of a spring contact, wherein the spring contact includes two clamping arms connected by a central segment and each clamping arm includes a protrusion that extends into a free space between the clamping arms, wherein the spring contact contacts the first conductive track of the first circuit board and the spring contact contacts the second conductive track of the second circuit board to form an electrical connection between the first conductive track and the second conductive track, wherein the first conductive track of the first circuit board faces the second conductive track of the second circuit board, and wherein the protrusions of the clamping arms are offset from one another along a vertical z-axis.

2. The light fixture according to claim 1, wherein the spring contact is fastened on the second circuit board by means of at least one of a soldered connection and a clamp connection.

3. The light fixture according to claim 1, wherein the dimensions of the spring contact are such that, in a contact region of the first circuit board and in a contact region of the second circuit board, the spring contact exerts a residual spring force on the first circuit board or the second circuit board.

4. The light fixture according to claim 1, wherein a spring deflection of the spring contact corresponds to at least a thickness of the first circuit board.

5. The light fixture according to claim 1, wherein the spring contact contacts the second conductive track of the second circuit board in a planar manner.

6. The light fixture according to claim 1, wherein the spring contact extends in a curved manner in at least one end region in such a way that an end edge of the spring contact projects away from at least one of the first circuit board and the second circuit board.

7. The light fixture according to claim 6, wherein a bend of the spring contact touches at least one of the first conductive track of the first circuit board in a contact region and the second circuit board in a contact region.

8. The light fixture according to claim 1, wherein the second circuit board is clamped between the two clamping arms.

9. The light fixture of claim 8, wherein the second circuit board has indentations that the protrusions of the spring contact engage.

10. The light fixture of claim 9, wherein the indentations of the second circuit board are positioned on opposing sides of the second circuit board.

* * * * *